US005361609A

United States Patent [19]

Hasui et al.

[11] Patent Number: 5,361,609

[45] Date of Patent: Nov. 8, 1994

[54] STEAM SETTING APPARATUS

[75] Inventors: Keini Hasui, Ohtsu; Yasuhiro Inoue, Settu; Isao Fukuda, Kameoka, all of Japan

[73] Assignee: Murata Kikai Kabushiki Kaisha, Kyoto, Japan

[21] Appl. No.: 72,715

[22] Filed: Jun. 7, 1993

[30] Foreign Application Priority Data

Jun. 10, 1992 [JP] Japan ..... 4-176061
Nov. 13, 1992 [JP] Japan ..... 4-328685

[51] Int. Cl.[5] ..... D06B 3/09

[52] U.S. Cl. ..... 68/5 D; 28/285; 57/281; 57/308; 242/35.5 A

[58] Field of Search ..... 68/5 R, 5 C, 5 D, 5 E, 68/8; 57/281, 308; 242/35.5 A; 28/285; 19/66 R, 66 C

[56] References Cited

U.S. PATENT DOCUMENTS

| | | | |
|---|---|---|---|
| 1,670,262 | 5/1928 | Kershaw | 68/5 D X |
| 4,718,257 | 1/1988 | Reinehr et al. | 68/5 E |
| 4,893,483 | 1/1990 | Kawasaki et al. | 68/5 C |
| 4,953,368 | 9/1990 | Kawasaki et al. | 68/5 C |
| 4,995,230 | 2/1991 | Tone et al. | 68/5 C X |

*Primary Examiner*—Philip R. Coe
*Attorney, Agent, or Firm*—Spensley Horn Jubas & Lubitz

[57] ABSTRACT

An automatic winder having a steam setting apparatus in which a steam setter for steaming bobbins is disposed along winding units behind a winder body in a system connecting an automatic winder for rewinding spinning bobbins to a fine spinning frame including a multitude of spindles for producing spinning bobbins, and a drying-holding line is provided subsequently to the steam setter.

10 Claims, 10 Drawing Sheets

STEAM SETTING APPARATUS

BACKGROUND OF THE INVENTION

1. Field of the Invention

The present invention relates to a steam setting apparatus connected between a fine spinning frame and an automatic winder, for steaming bobbins mounted on trays while circulating them between the fine spinning frame and the automatic winder.

2. Prior Art

Generally, when a yarn to be supplied from a fine spinning frame to an automatic winder is a wool yarn, the wool yarn will be torqued during unwinding before entering a following twisting process. In the bobbin processing system located between the fine spinning frame and the automatic winder, therefore, a steam setter (refer to Japanese Patent Laid-Open No. SHO 61-215728) is provided for steaming the spinning bobbin before it enters the automatic winder, thereby removing the torque from the yarn.

On the surface of the bobbin discharged out after passing through the steam setter, water drips are present in a condensed state. The drips, if left unremoved, will adhere to various members of the winder in the following process, forming rust on the members.

SUMMARY OF THE INVENTION

An object of the present invention is to remove excessive moisture including water drips likely to adhere to the surface of bobbins passing through the steam setter.

Another object of the present invention is to provide a steam setting apparatus which is capable of steaming at least two kinds of yarns in a single steam setter.

Still another object of the present invention is to prevent spinning bobbins discharged from the winder body without being rewound from being sent into a steam setter for re-steaming.

To accomplish the above-described object, the steam setting apparatus of the present invention is equipped with a drying-holding line, which follows the steam setter.

In the steam setting apparatus of the aforesaid constitution, spinning bobbins discharged after steam setting will flow through the drying-holding line to remove excessive water content.

To accomplish the above-described second object, the steam setting apparatus of the present invention has a steam setter and a standby line for waiting for bobbins which are fed thereto according to type, and for receiving all of bobbins all together when discharged from the steam setter after completion of steaming.

In the steam setting apparatus of the above-described constitution, the bobbins sent separately by type to the steam setter are once halted before the steam setter, and the bobbins of one kind are discharged all together after each type of bobbin has been steamed in the steam setter, another kind of bobbin is fed all at once into the steam setter and steamed under specific steaming conditions.

Further, to accomplish the above-described third object, an automatic winder having a yarn end finding device and a steam setter of the present invention comprises a device mounted for recognizing discharge of a tray from the steam setter to a transfer line extending from the steam setter to the winder body, and a device mounted, for ascertaining the tray recognized by the discharge recognizing device, on a transfer line extending from the yarn end finding device to the steam setter, and the tray thus ascertained is delivered to the winder body.

DETAILED DESCRIPTION OF PREFERRED EMBODIMENT

Figure 1:
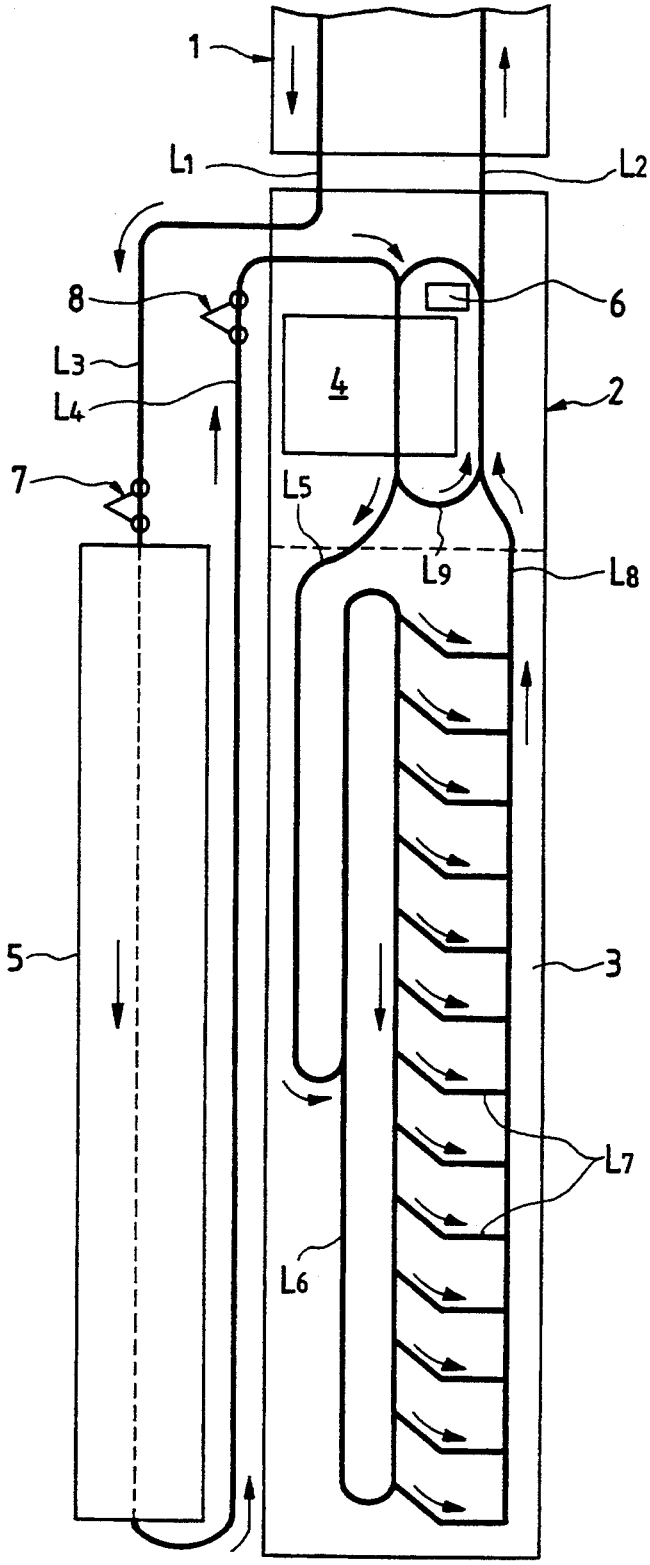
FIG. 1 is a schematic plan view of a first embodiment of a steam setting apparatus according to the present invention.

Hereinafter a first embodiment of a steam setting apparatus according to the present invention will be explained with reference to FIGS. 1 and 2.

This steam setting apparatus is equipped with a known steam setter 5 for steam setting a spun-yarn bobbin, behind a winder body 3 in a system for connecting a fine spinning frame 1 comprising a multitude of spindles for producing spun-yarn bobbins (hereafter also called the spinning bobbins) to an automatic winder 2 for rewinding the spun-yarn bobbins. In a connecting section between the fine spinning frame 1 and the automatic winder 2 are provided an incoming line $L_1$ for bringing in a spinning bobbin mounted on a tray and an outgoing line $L_2$ for discharging an empty bobbin left on the tray. Within the automatic winder 2 are mounted the winder body 3 comprising a multitude of spindle winding units, and a known yarn end finding device 4 for finding a yarn end on the spinning bobbin. The tray carrying the spinning bobbin (full tray) travels on a transfer line going around to each part between the winder body 3 and the yarn end finding device 4.

The transfer line consists of an unset spinning bobbin standby line $L_3$ extending from the incoming line $L_1$ to the steam setter 5, a drying-holding line $L_4$ extending from the steam setter 5 to the yarn end finding device 4, a supply line $L_5$ s for supplying the spinning bobbin with a yarn end led out by the yarn end finding device 4 to the winder body 3, a guide line $L_6$ formed circulating along the longitudinal direction of the winder body 3, a discharge line $L_7$ for discharging an empty tray on which a bobbin wound with a yarn from each spindle of the winder body 3 will be mounted, an outgoing line $L_8$ for carrying, to the fine spinning frame 1 side, an empty tray discharged from each discharge line $L_7$, and a circulating line $L_9$ for sending a spinning bobbin back to the yarn end finding device 4 in case the yarn end finding device 4 has failed to find the yarn end.

When a little yarn remains on the bobbin mounted on the tray being carried from the outgoing line $L_8$ to the outgoing line $L_2$, the remaining yarn is removed by means of a bobbin stripper 6, and the bobbin thus emptied is returned to the fine spinning frame 1 by the outgoing line $L_2$. Also, when there remains 30 percent or more of yarn on the bobbin on the tray being carried from the outgoing line $L_8$ to the outgoing line $L_2$, the bobbin will be returned to the yarn end finding device 4 from the circulating line $L_9$.

A stopper 7 for holding the full tray is provided in the vicinity of the downstream end of the unset spinning bobbin standby line L, and a stopper 8 for holding and drying streamed full trays coming from the steam setter 5 is disposed in the vicinity of the downstream end of the drying-holding line $L_4$.

Figure 2:
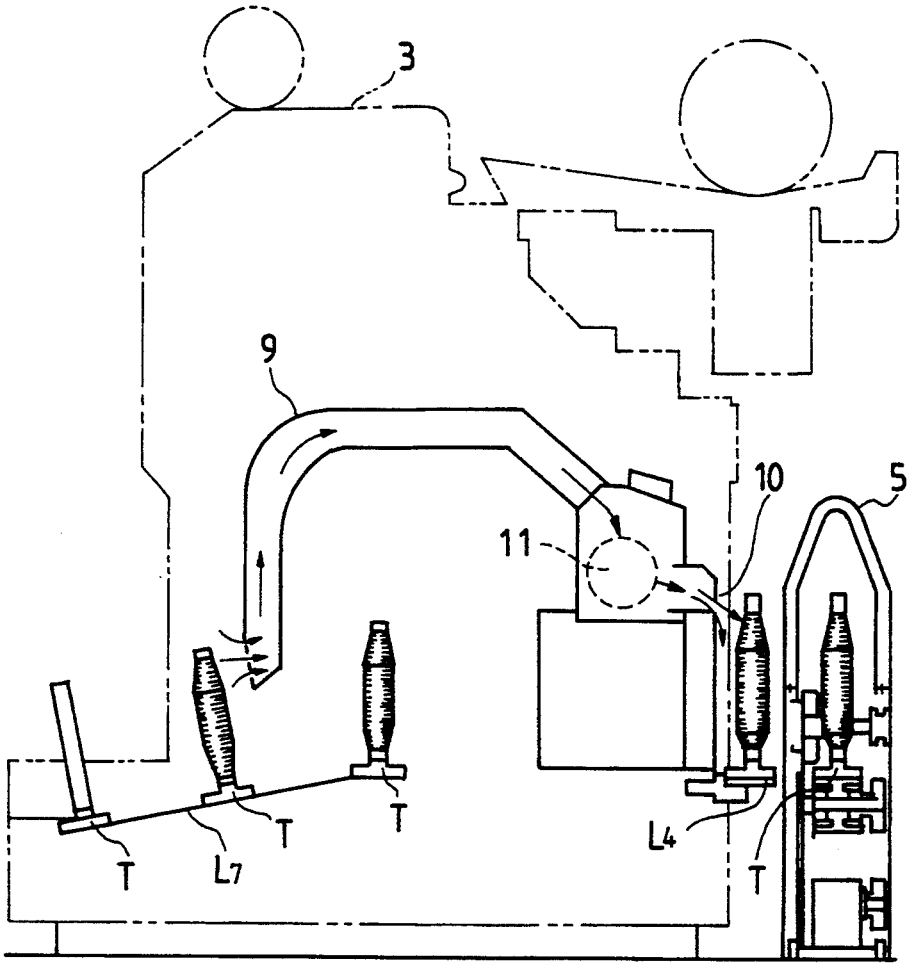
FIG. 2 is a side view showing the relation between a winder body, a steam setter, and a steam-set spinning bobbin standby line in the first embodiment.

The steam setter 5, as shown in FIG. 2, is located behind the winder body 3, between which extends the drying-holding line $L_4$. The winder body 3 is equipped with a suction cleaner 9 for sucking to remove fly waste flying off the yarn during winding. A suction air outlet port 10 is open in the back of the winder body 3. An air stream blowing out from this air outlet port 10 is applied to a set spinning bobbin that has been carried out from the steam setter 5 by the drying-holding line $L_4$ and therefore is convenient for drying. A reference numeral 11 is a fan for producing this air stream.

In the steam setting apparatus of the above-described constitution, the spinning bobbin brought in by the incoming line $L_1$ is sent to the unset spinning bobbin standby line $L_3$, being stopped behind the stopper 7. In the meantime, after the completion of steam setting of spinning bobbins at the steam setter 5, trays of these spinning bobbins are all delivered out to the drying-holding line $L_4$, being sequentially stopped in the front of the stopper 8. The spinning bobbins are then dried with air blowing out from the air outlet port 10 of the suction cleaner 9 which is open in the back of the winder body 3. Simultaneously with the delivery of the spinning bobbin, the tray held on the unset spinning bobbin standby line $L_3$ is allowed to advance into the steam setter 5 with the release of the stopper 7, being steam set. Also, the full trays previously delivered onto the drying-holding line $L_4$ are supplied one by one into the yarn end finding device 4, with the stopper 8 released every time the supply of the full trays is required by the yarn end finding device 4, where the yarn end is led out, then being discharged out to the supply line $L_5$. Thereafter, the tray is sent to the guide line $L_6$, circulating to be taken in to a spindle where the tray is required. An empty tray after winding advances from the discharge line $L_7$ to the outgoing line $L_8$, coming to the bobbin stripper 6, where an empty bobbin is removed and sent back to the fine spinning frame 1 side and at the same time the tray is sent to the end of each incoming line $L_1$, where the tray waits until a spinning bobbin is supplied.

Figure 3:
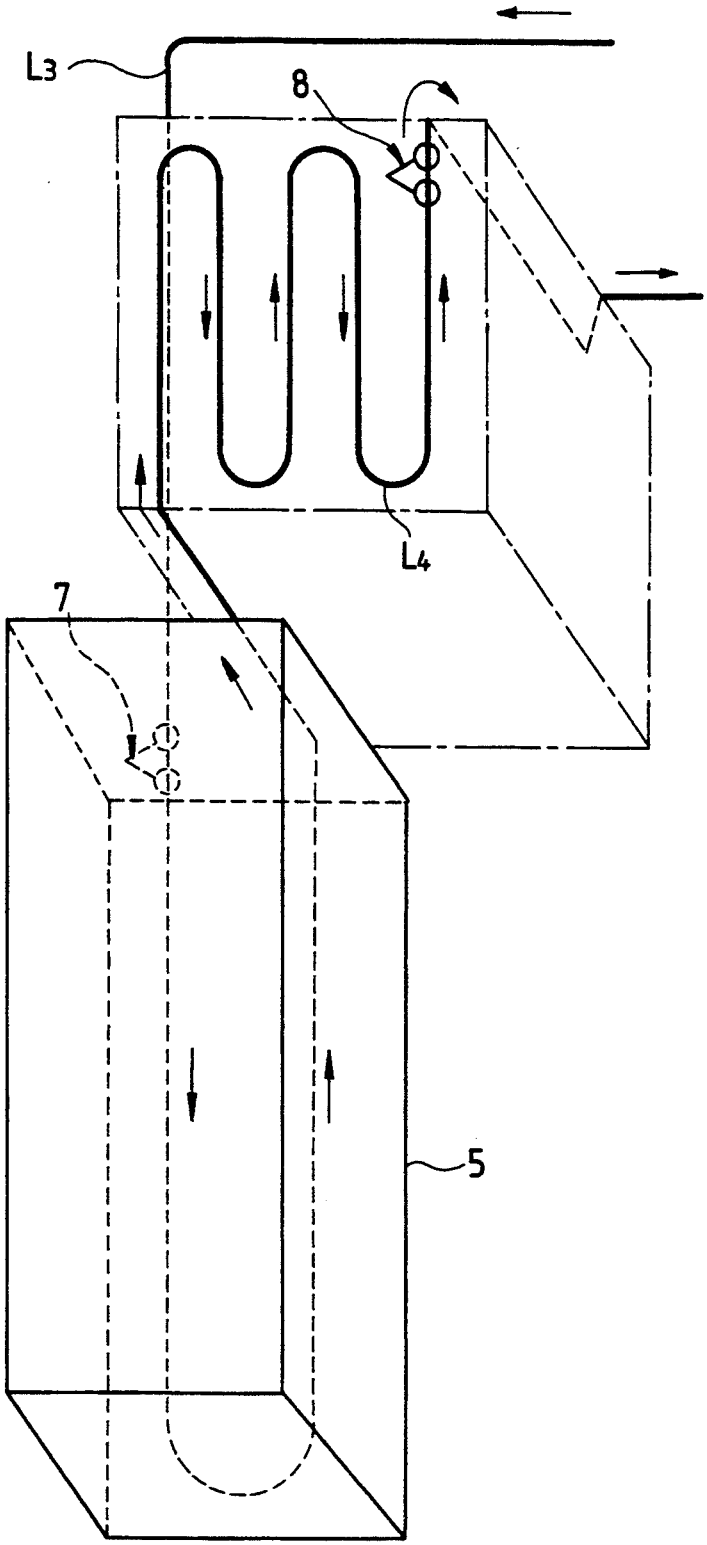
FIG. 3 is a perspective view showing the arrangement of a steam setter, an unset spinning bobbin standby line, and a drying-holding line of another embodiment of the steam setting apparatus according to the present invention.
Figure 4:
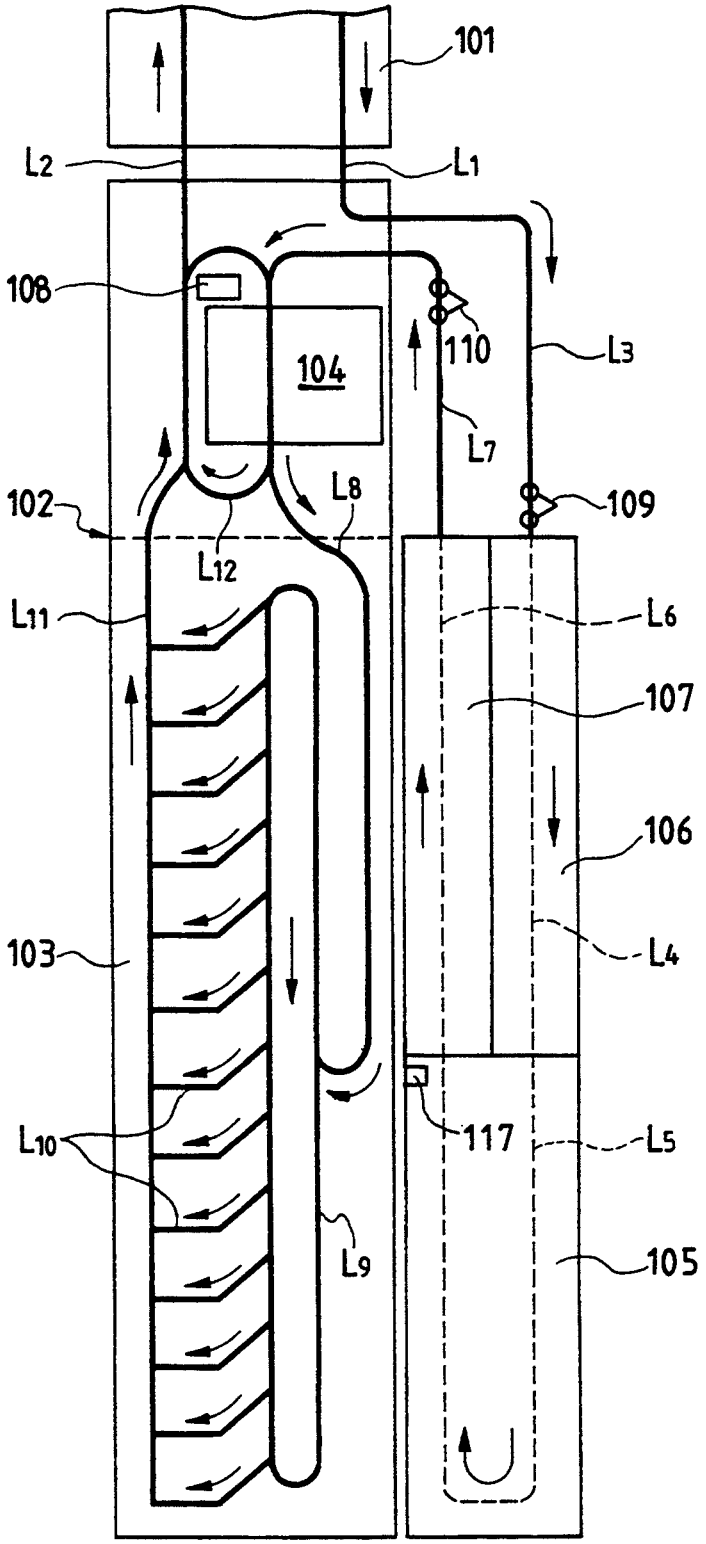
FIG. 4 is a schematic plan view of a steam setting apparatus according to a second embodiment of the present invention.

Next, by referring to FIG. 3, another embodiment of the steam setting apparatus according to the present invention will be explained. This steam setting apparatus also is basically the same in construction as that of the first embodiment, and therefore only differences will be explained. It should be noted that the same parts will be designated by the same reference numerals.

A first difference lies in that a spinning bobbin from the unset spinning bobbin standby line $L_3$ enters the steam setter 5, within which the spinning bobbin advances in a staggered manner. In this case the steam setter 5 becomes a little wider, but decreases in length to a half of the steam setter 5 of the first embodiment, thereby improving thermal efficiency.

A second difference lies in that the driving-holding line $L_4$ extends upward from the outlet of the steam setter 5, staggering on the upper flat surface and not extending to the back of the winder body 3. The adoption of such a constitution requires no clearance between the winder body 3 and the steam setter 5, but occupies a slightly increased space widthwise of the steam setter. In addition, a sufficient length of the drying-holding line $L_4$ can be ensured without thereby increasing the space. In the steam setting apparatus, the air blowing out of the air outlet port 10 of the winder body 3 will not act on the spinning bobbin on the drying-holding line $L_4$, but the drying of the spinning bobbin can be performed if the drying-holding line $L_4$ has at least a specific length.

The present invention, being constituted as described above, has the following advantage.

That is, it is possible to remove excess water content such as water drips from the surface of the steam-set bobbin discharged from the steam setter, without adding a special device. Accordingly no water drips will adhere to any member of devices in the following processes. The members of these devices, therefore, will not become rusty, thus improving durability and facilitating finding of a yarn end. Furthermore, utilizing exhaust air from the fly waste removing fan for drying spinning bobbins after steam setting can dry the bobbins at a higher rate.

Hereinafter a steam setting apparatus according to a second embodiment of the present invention will be explained with reference to FIGS. 4 to 8.

This steam setting apparatus is equipped with a known steam setter 105 for steam setting a spinning bobbin, behind a winder body 103 in a system for connecting a fine spinning frame 101 comprising a multitude of spindles for producing spinning bobbins to an automatic winder 102 for rewinding the spinning bobbins. And on its inlet and outlet sides are placed a preheating apparatus 106 and a drying apparatus 107. In a connecting section between the fine spinning frame 101 and the automatic winder 102 are provided an incoming line $L_1$ for bringing in the spinning bobbin mounted on a tray and an outgoing line $L_2$ for discharging an empty bobbin left on the tray. Within the automatic winder 102 are mounted the winder body 3 comprising a multitude of spindle winding units, and a known yarn end finding device 104 for finding a yarn end on the spinning bobbin. The tray carrying the spinning bobbin (full tray) travels on a transfer line going around to each part between the winder body 103 and the yarn end finding device 104.

The transfer line consists of an unset spinning bobbin standby line $L_3$ extending from the incoming line $L_1$ to the preheating apparatus 106, a passage $L_4$ extending into the preheating apparatus 106, a passage $L_5$ extending in a zigzag manner within the steam setter 105, a passage $L_6$ extending into the drying apparatus 107, a set spinning bobbin standby line $L_7$ extending from the drying apparatus 107 to a yarn end finding device 104, a supply line $L_8$ for supplying the spinning bobbin with a yarn end led out by the yarn end finding device 104 to the winder body 103, a guide line $L_9$ formed circulating along the longitudinal direction of the winder body 103, a discharge line $L_{10}$ for discharging an empty tray on which a bobbin wound with a yarn from each spindle of the winder body 103 will be mounted, an outgoing line $L_{11}$ for carrying, to the fine spinning frame 101 side, an empty tray discharged from each discharge line $L_{10}$, and a circulating line $L_{12}$ for sending a spinning bobbin back to the yarn end finding device 104 in case the yarn end finding device 104 has failed to find the yarn end.

When a little yarn remains on the bobbin mounted on the tray being carried from the outgoing line $L_{11}$ to the outgoing line $L_2$, the remaining yarn is removed by means of a bobbin stripper 8, and the bobbin thus emptied is returned to the fine spinning frame 101 by the outgoing line $L_2$. Also, when there remains 30 percent or more of yarn on the bobbin on the tray being carried from the outgoing line $L_{11}$ to the outgoing line $L_2$, the bobbin will be returned to the yarn end finding device 104 from the circulating line $L_{12}$.

A stopper 109 for holding the full tray is provided in the vicinity of the downstream end of the unset spinning bobbin standby line $L_3$, and a stopper 110 for holding a full tray that has been steamed at the steam setter 105 and dried at the drying apparatus 107 is disposed in the vicinity of the downstream end of the set spinning bobbin standby line $L_7$.

Figure 5:
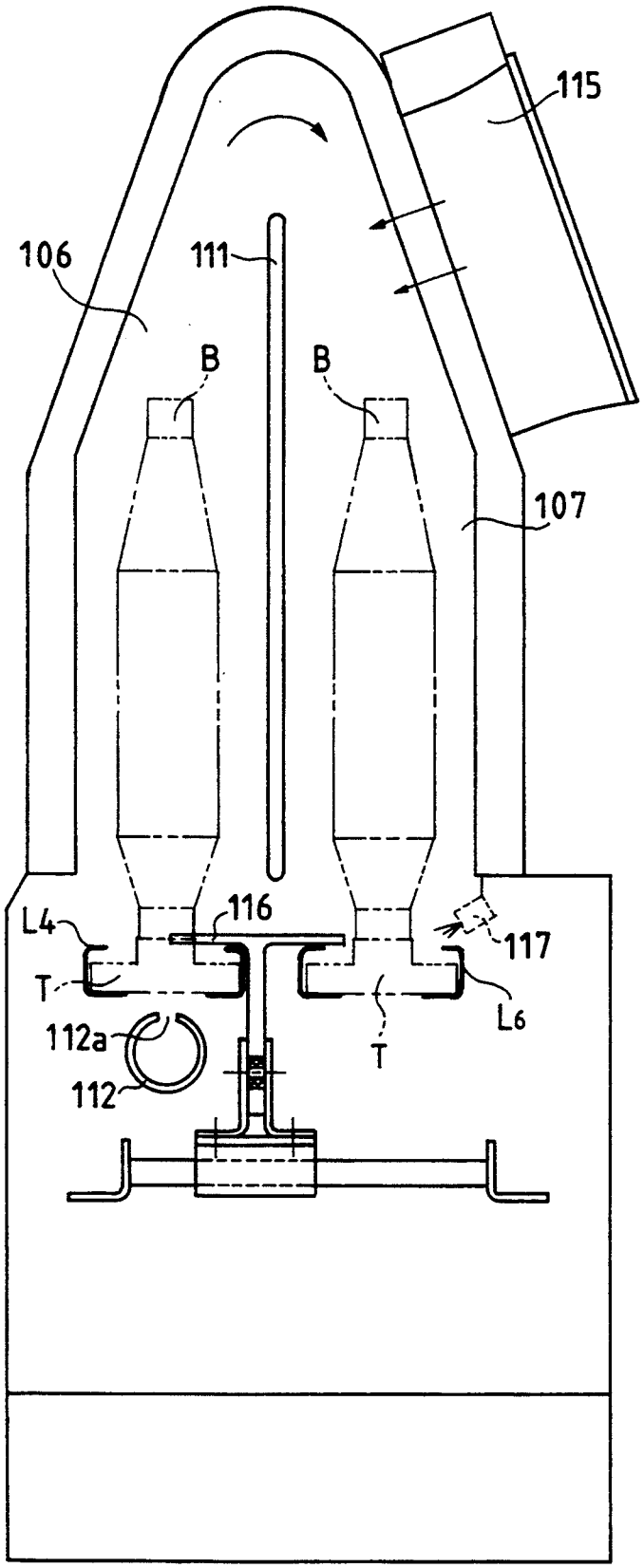
FIG. 5 is a sectional view of a preheating apparatus and a drying apparatus.
Figure 6:
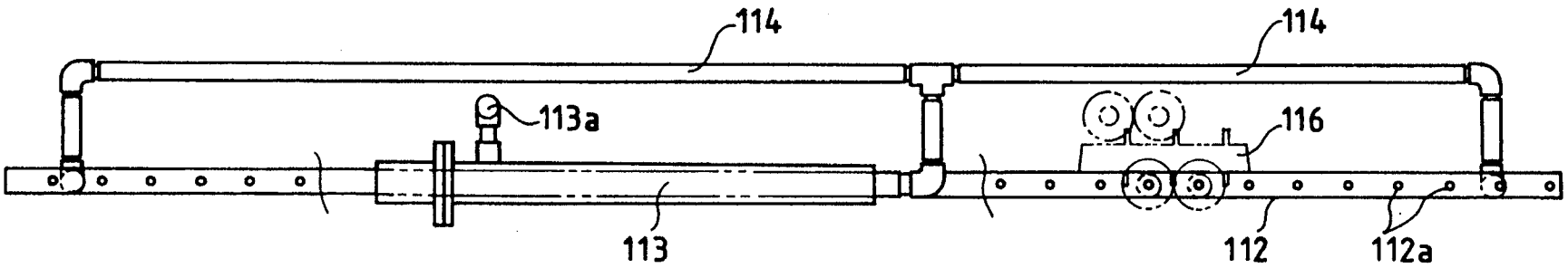
FIG. 6 is a plan view of the interior of the preheating apparatus and the drying apparatus.

The preheating apparatus 106 and the drying apparatus 107, as shown in FIG. 5, are juxtaposed between a partition plate 111 within one housing.

Figure 7:
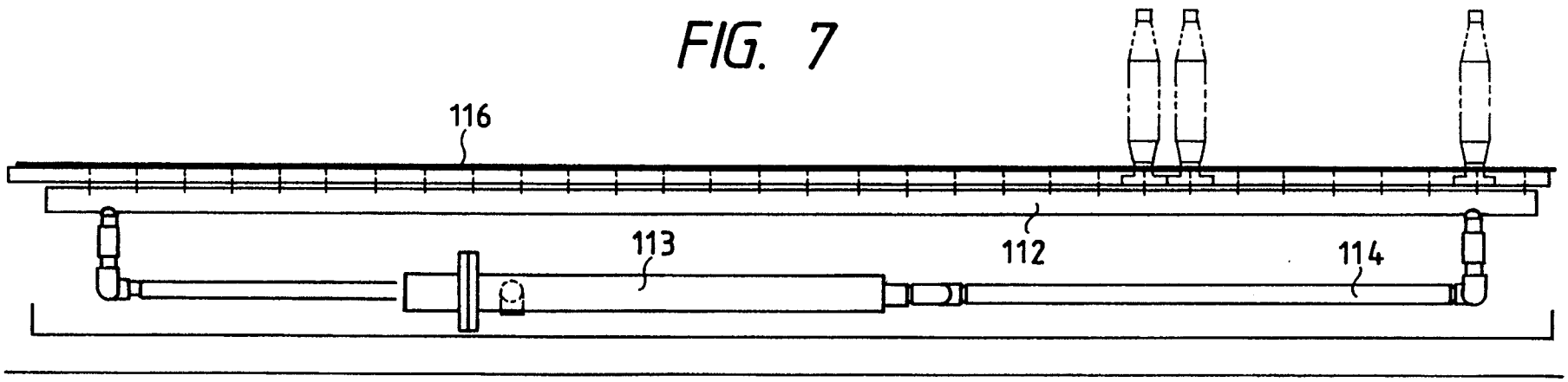
FIG. 7 is a side view of the interior of the preheating apparatus.

Beneath the passage $L_4$ of the preheating apparatus 106 is installed a hot-air supply pipe 112 provided with holes 112*a* drilled in the upper part at a little longer intervals than the outside diameter of the tray T (in FIG. 7, positions of the holes 112*a* are indicated by dotted lines at equal intervals). Into this hot-air supply pipe 112 is sent hot air through a piping 114 from a heating chamber 113 which incorporates a built-in heater for heating the air drawn in at an air inlet port 113*a*. Also provided in the bottom of the passage $L_4$ are holes at equal intervals corresponding to the holes 112*a* in the hot-air supply pipe 112.

The hot air being blown up from each hole 112*a* of the hot-air supply pipe 112 passes the center of the bobbin B from the center of each of the trays T being carried in the passage $L_4$, thereby heating each bobbin B.

Above the drying apparatus 107 is mounted a fan 115 for taking in the outside air. Also from above the partition plate 111 the exhaust air is supplied from the preheating apparatus 106. The wet spinning bobbin discharged from the steam setter 105 is then dried by the exhaust air stream while passing through the passage $L_6$. This air stream is discharged from below the drying apparatus 107.

Figure 8:
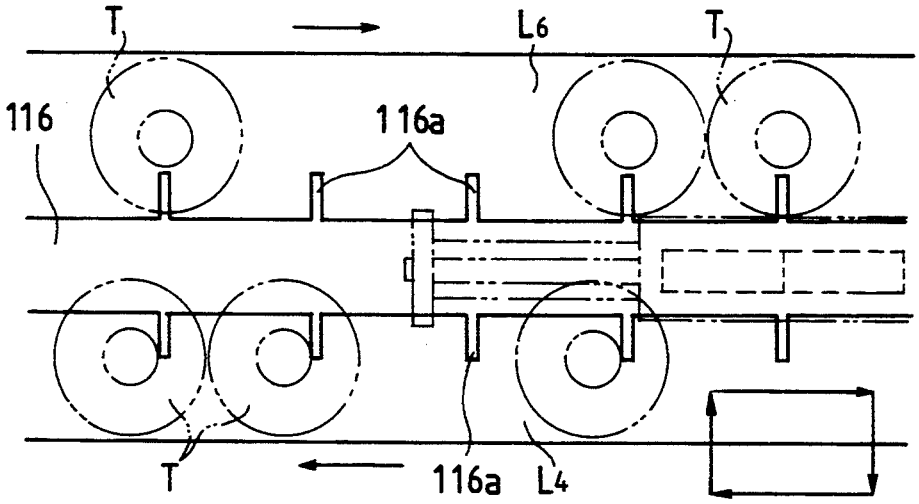
FIG. 8 is a plan view explaining the operation of transfer plates in the preheating apparatus and the drying apparatus.

Between the passage $L_4$ of the preheating apparatus 106 and the passage $L_6$ of the drying apparatus 107 is disposed a transfer plate 116 for transferring the trays T intermittently by each pitch in a direction opposite to each other in the passage $L_4$ and the passage $L_6$ as shown in FIG. 8.

On both sides of the transfer plate 116 are formed a plurality of projecting pieces 116*a* at intervals equal to those of the holes 112*a* provided in the hot-air supply pipe 112. This transfer plate 116, repeats forward, rightward, backward and leftward movement as indicated by four arrows on the right of FIG. 8. This movement is done by means of an air cylinder for rightward and leftward movement and an air cylinder for forward and backward movement, not shown.

As the transfer plate 116 moves forward from the position shown in FIG. 8 (leftward movement in FIG. 8), each projecting piece 116*a* on the passage $L_4$ side of the preheating apparatus 106 pushes forward a projection at the center of the tray T in the passage $L_4$, moving each tray T one pitch forward. Subsequently, the transfer plate 116 moves rightward to disengage the tray T in the passage $L_4$ and at the same time each projecting piece 116*a* on the passage $L_6$ side of the drying apparatus 107 moves backhind the projection of the tray T in the passage $L_6$. Then, when the transfer plate 116 moves backward (rightward movement in FIG. 8), the tray T in the passage L advances one pitch in the passage $L_6$ while the tray T in the passage $L_4$ remains stationary.

Finally, in the vicinity of the outlet of the steam setter 105 is provided a nozzle 117 at which the air is injected toward the tray T which is travelling in the passage $L_5$, thereby blowing off water drips which are formed on the tray T in the steam setter 105.

In the steam setting apparatus of the above-described constitution, the spinning bobbin brought in by the incoming line $L_1$ is sent to the unset spinning bobbin standby line $L_3$ and stopped behind the stopper 109. When the preheating apparatus 106 becomes empty, full bobbins are fed into the preheating apparatus 106, where the spinning bobbins are heated. Next, the spinning bobbins are steamed in the steam setter 105. In this case since the bobbins have been heated, no moisture is formed on the bobbins. Subsequently, the bobbins are dried in the drying apparatus 107, then delivered to the set spinning bobbin standby line $L_7$ and stopping in order before the stopper 110. Then, the stopper 110 is released each time the supply of the bobbins to the yarn end finding device 104 is demanded; the bobbins are sent one by one into the yarn end finding device 104, where the yarn end is led out. The bobbin with the yarn end thus led out is then discharged to the supply line $L_8$. Thereafter the tray is sent to the guide line $L_9$, circulating to a spindle which is demanding a spinning bobbin. A tray which has become empty after unwinding advances from the discharge line $L_{10}$ to the outgoing line $L_{11}$, and a remaining yarn is removed by the bobbin stripper 108. The empty bobbin is returned to the fine spinning frame 101 by means of the outgoing line $L_2$.

The present invention, being constituted as described above, has the following advantage.

That is, when the spinning bobbin is steam-set by the steam setter, the bobbin has already been heated, and therefore no moisture will be formed on the bobbins and therefore the yarn wound near the bobbin surface will not get wet and there will be no deterioration of yarn quality.

The steam setting apparatus described above is designed to handle one kind of yarn. When at least two kinds of yarns are to be handled on one fine spinning frame, steam setting temperature and time required vary. This steam setting apparatus, therefore, is unsuitable.

A third embodiment of the present invention provides a steam setting apparatus which is capable of steaming at least two kinds of yarns in a single steam setter.

Figure 9:
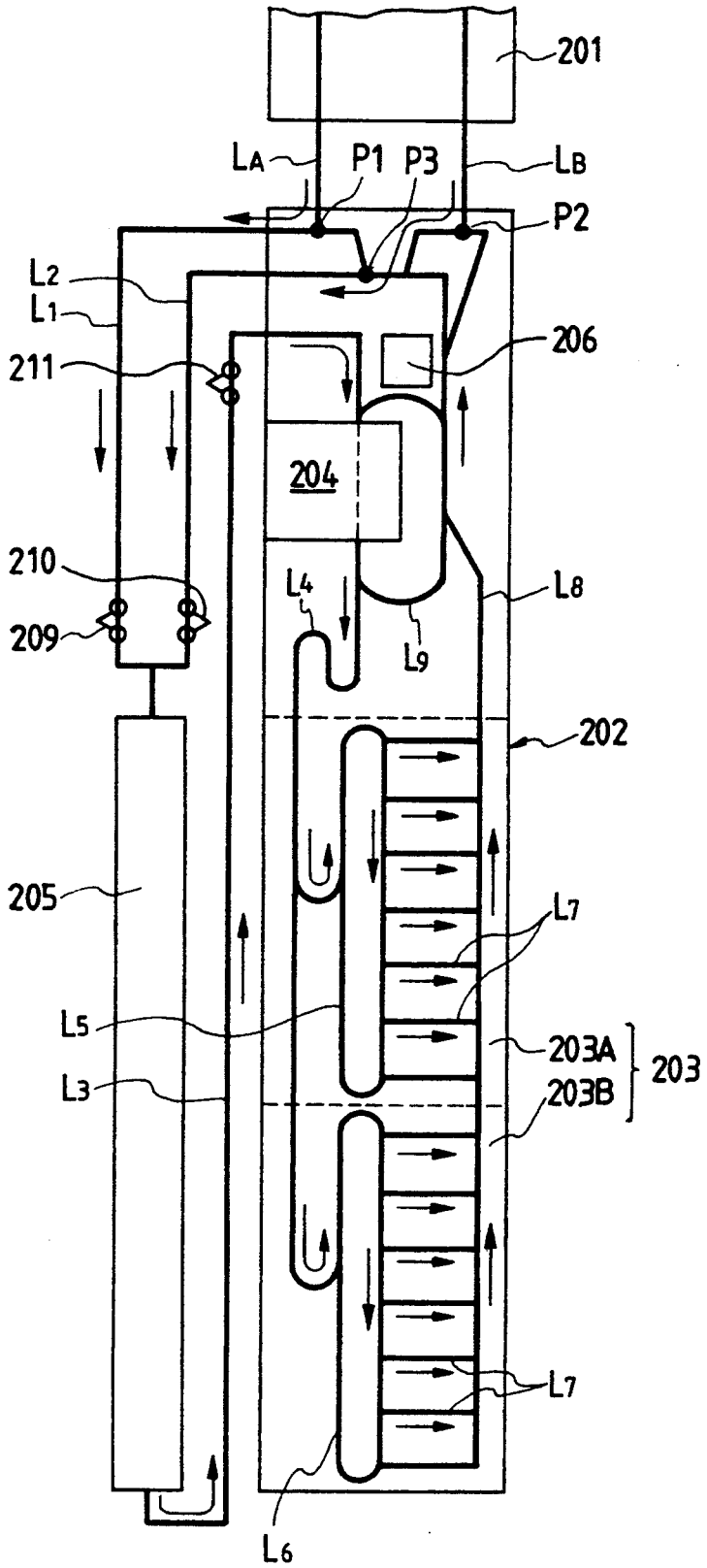
FIG. 9 is a schematic plan view of a third embodiment of the steam setting apparatus of the present invention.

By referring to FIGS. 9 to 11, the third embodiment of a steam setting apparatus according to the present invention will be explained.

The steam setting apparatus is equipped with a known steam setter 205 for steam setting a spinning bobbin, behind a winder body 203 in a system for connecting a fine spinning frame 201 comprising a multitude of spindles for producing spinning bobbins to an automatic winder 202 for rewinding the spinning bobbins. At the connecting section between the fine spinning frame 201 and the automatic winder 202 are provided an incoming line $L_A$ for bringing in spinning bobbins of A type yarn and an incoming line $L_B$ for bringing in spinning bobbins of B type yarn. Inside the automatic winder are mounted a winder body 203 comprising a multiple-spindle winding unit and a known yarn end finding device 204 for finding yarn end on spinning bobbins. Trays mounted with the spinning bobbins (full trays) travel on a transfer line which circulates through each section between the automatic winder body 203 and the yarn-end finding device 204.

The automatic winder body 203 consists of a rewinding section 203A for rewinding spinning bobbins of A type yarn and a rewinding part 203B for rewinding spinning bobbins of B kind yarn.

The transfer line comprises unset spinning bobbin standby lines $L_1$ and $L_2$ extending from the incoming lines $L_A$ and $L_B$ respectively to a steam setter 205, a set spinning bobbin standby line $L_3$ extending from the steam setter 205 to the yarn end finding device 204, a supply line $L_4$ for supplying spinning bobbins to the winder body 203 after their yarn end is led out by the yarn end finding device 204, introducing lines $L_5$ and $L_6$circulating along the longitudinal direction of the front part of each of the parts 203A and 203B of the winder body 203, a discharge line $L_7$ for discharging a tray (an empty tray) from each spindle of the winder body 203, and to be mounted with a fully wound bobbin, an outgoing line $L_8$ for carrying to the fine spinning frame 201 side the empty tray discharged from each discharge line $L_7$, and a circulating line $L_9$ for returning to the yarn end finding device 204 the spinning bobbin that the yarn end finding device 204 has failed to find the yarn end.

The incoming lines $L_A$ and $L_B$ straddle the fine spinning frame 201 and the automatic winder 202 forming an arch; the spinning bobbins are inserted upright on pegs which protrude at equal intervals on the incoming lines $L_A$ and $L_B$, and carried as far as the end parts a and b of the incoming lines $L_A$ and $L_B$, where the spinning bobbins are lowered for insertion onto trays which are waiting. In the meantime, bobbins on empty trays being carried on the outgoing line $L_8$ are removed from the trays by means of an empty bobbin stripping device 206. The tray, after the removal of the bobbin, is carried as far as the end parts P1 and P2 of the incoming lines $L_A$ and $L_B$, where it waits for the insertion of a spinning bobbin. The bobbin thus removed from the tray is carried to the outgoing line (not illustrated) which extends upward to the fine spinning frame 201 side.

Figure 10:
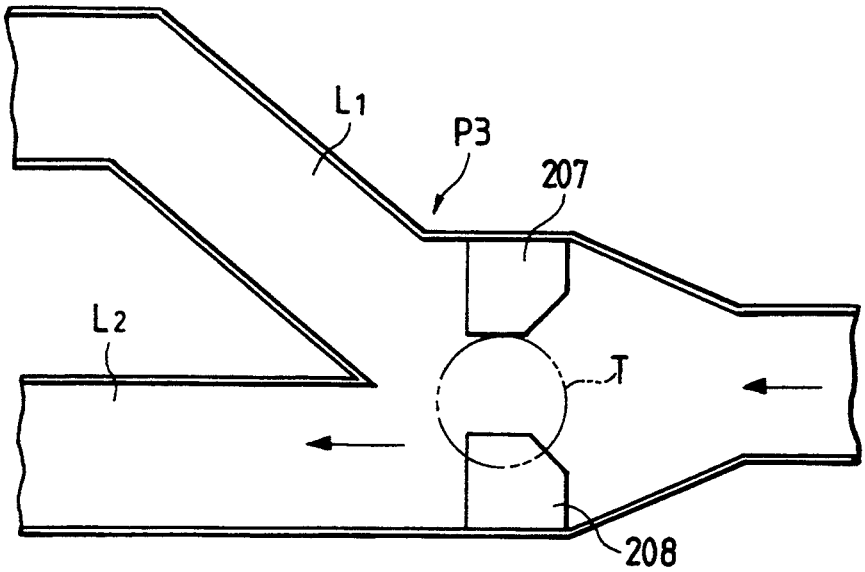
FIG. 10 is a plan view of a branching part of each unset spinning bobbin standby line.
Figure 11:
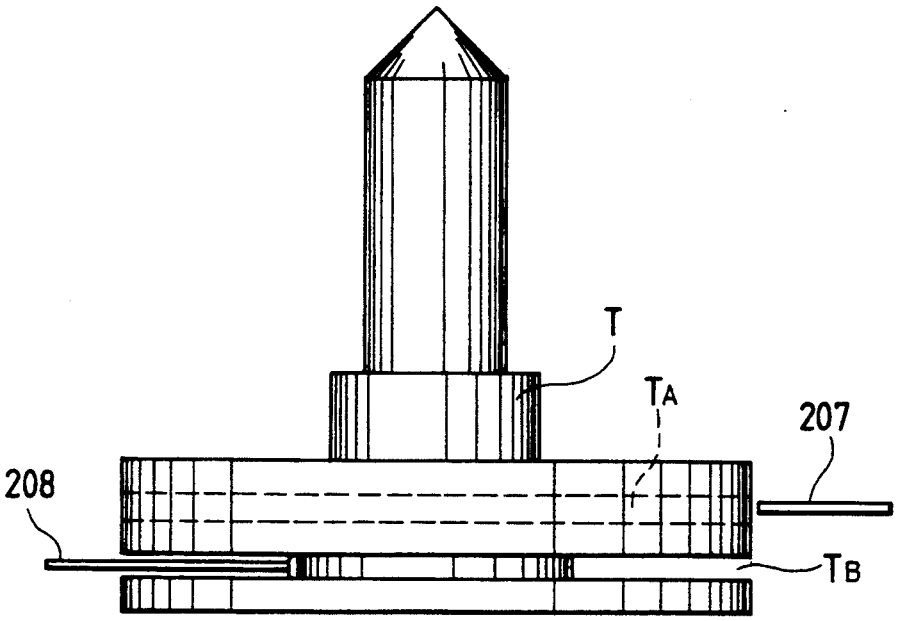
FIG. 11 is a view showing a relationship between a tray and a selection guide.

At the branching part P3 of the unset spinning bobbin standby lines $L_1$ and $L_2$ are provided selection guides 207 and 208 protruding from each side as shown in FIG. 10. These selection guides 207 and 208, as shown in FIG. 11, differ in height from each other. The tray T is provided with an annular groove $T_A$ or an annular groove $T_B$ for the selection of the A or B yarns of bobbins mounted, at a level corresponding to the height of the selection guide 207 or the selection guide 208. For example, the tray T with the annular groove $T_B$, when having come into the branching part P3, is pushed by the selection guide 207; in this case, however, as the other selection guide 208 enters the annular groove $T_B$, the tray T is moved toward the unset spinning bobbin standby line $L_2$ side, thus advancing on the standby line $L_2$. The tray T having the annular groove $T_A$ is diverted backwards to the unset spinning bobbin standby line $L_1$. A branching part where the introducing line $L_5$ is branched off from the supply line $L_4$ and a branching part where the end parts P1 and P2 of the incoming lines $L_A$ and $L_B$ are branched off from the outgoing line Le and have the same function as the branching part P3.

There are mounted a stopper 209 for holding a full tray for A yarn, in the vicinity of the downstream end of the unset spinning bobbin standby lines $L_1$ and $L_2$, and a stopper 211 for holding a full tray steamed at the steam setter 205, in the vicinity of the downstream end of the set spinning bobbin standby line $L_3$. The steam setter 205 is of the same constitution as that shown in FIG. 2.

In the steam setting apparatus constituted as described above, A and B spinning bobbins fed by type from the incoming lines $L_A$ and $L_B$are separated and sent to the unset spinning bobbin standby lines $L_1$ and $L_2$ respectively, being stopped behind the stopper 209 and the stopper 210. On the other hand, when the A kind spinning bobbins are present in the steam setter 205 after the completion of steam setting, all trays carrying the spinning bobbins are delivered out to the set spinning bobbin standby line $L_3$, coming to a standstill in front of the stopper 211. At the same time, with the release of the stopper 210, the B trays held on the unset spinning bobbin standby line $L_2$ advance into the steam setter 205, where the spinning bobbins are steam-set at a different temperature and for a different period of time those for the A yarn but suitable for the B yarn. Every time the supply of full trays is demanded by the yarn end finding device 204, the stopper 211 is released and the A full trays previously delivered from the set spinning bobbin standby line $L_3$ are supplied one by one to the yarn end finding device 204, where the yarn end of each bobbin is led out. The full trays are then discharged to the supply line $L_4$. Thereafter, the trays are sent to circulate on the introducing line $L_5$, being fed in to a spindle demanding for a bobbin. These operations are the same as those for the other of yarn. After winding, an empty tray advances from the discharge line $L_7$ to the outgoing line $L_B$, by which the empty tray is carried to the empty bobbin stripping apparatus 206, where an empty bobbin is removed, and returned to the fine spinning frame 201 side. At the same time, the tray is sent to the end part a or to the end part b of the incoming line $L_A$ or $L_B$, where it waits for a spinning bobbin.

The present invention, being constituted as described above, has the following advantage.

That is, it is possible to steam at least two different of spinning bobbins under separate conditions appropriate to each type by use of a single steam setter. When the steam setter is placed behind the winder body, it will become possible to use exhaust air from a fly-waste removing fan for drying the spinning bobbins after steam setting, facilitate yarn-end finding, and to decrease a distance between the fine spinning frame and the automatic winder.

Figure 12:
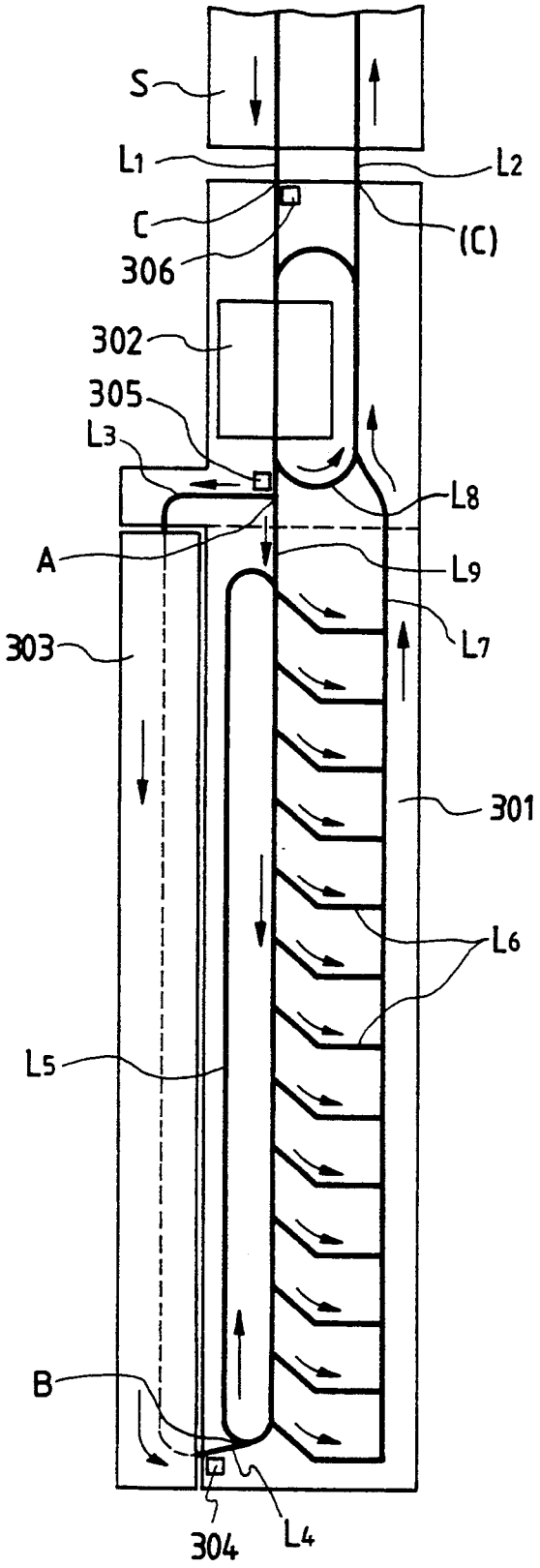
FIG. 12 is a schematic plan view of a fourth embodiment of the automatic winder according to the present invention.
Figure 13:
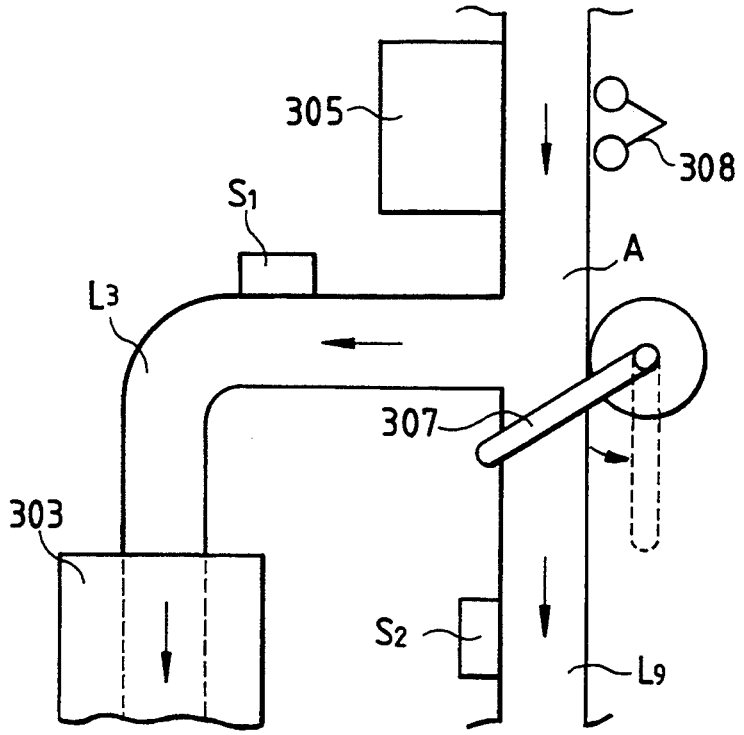
FIG. 13 is a plan view showing the vicinity of a steaming information reading unit in the automatic winder of the present invention.
Figure 14:
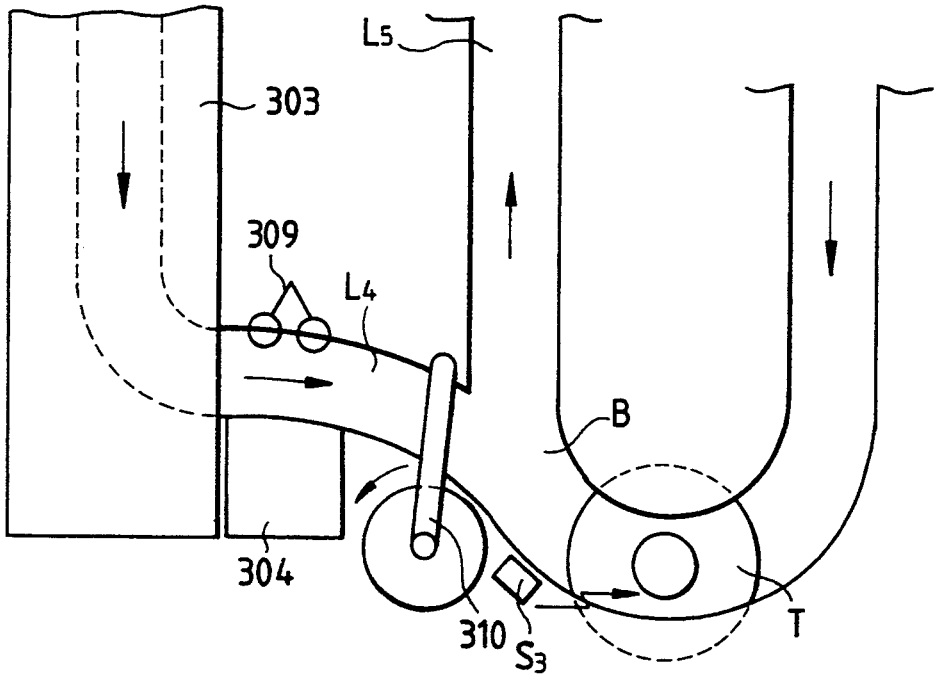
FIG. 14 is a plan view showing the vicinity of a steaming information writing unit in the automatic winder of the present invention.

Next, a fourth embodiment of the automatic winder according to the present invention will be explained with reference to FIGS. 12 to 14.

This automatic winder is equipped with a known yarn end finding device 302 for receiving spinning bobbins from the fine spinning frame S and finding the yarn end, at the side of a winder body 301 comprising a multiple-spindle winding unit for rewinding the spinning bobbins, and a known steam setter 303 for steam-setting the spinning bobbins behind the winder body 301. In the connecting section between the fine spinning frame S and the automatic winder are arranged the incoming line $L_1$ for bringing in a tray mounted with a spinning bobbin (full tray) and the outgoing line $L_2$ for carrying out a tray mounted with an empty bobbin (empty tray); the yarn end finding device 302 and the steam setter 303 are provided in the winder body 301 and the tray travels on the transfer line routed among them.

The transfer line comprises a charge line $L_3$ for carrying, to the steam setter 303, spinning bobbin with its yarn end led out at the yarn end finding device 302; a supply line $L_4$ for supplying the spinning bobbin steamed at the steam setter 303 to the winder body 301; an introducing line $L_5$ formed to circulate along the longitudinal direction of the winder body 301; a discharge line $L_6$ for discharging an empty tray from each unit of the winder body 301; an outgoing line $L_7$ for carrying the empty tray discharged from each discharge line $L_6$ to the fine spinning frame S side; a circulation line for returning a spinning bobbin to the yarn end finding device 302 when the yarn end finding device 302 has failed to find the yarn end of the spinning bobbin; and a return line $L_9$ for returning to the winder body 301 the full tray that has been discharged, without rewinding, from the unit of the winder body 301 to the discharge line $L_6$ and is to be sent back to the yarn end finding device 302.

On the tray carrying the spinning bobbin is attached an information recording body having a magnetic recording medium. At a confluence B of the supply line $L_4$ and the introducing line $L_5$ is mounted, as shown in FIG. 14, a writing unit 304 for entering yarn steaming information in the information recording medium that a full tray discharged from the steam setter 303 has been steamed; at a branching part A of the charge line $L_3$ and the return line $L_9$ is mounted, as shown in FIG. 13, a reading unit 5 for reading information (for judging the presence or absence of information on steaming) from the information recording medium for the purpose of separating the full trays to either the charge line $L_3$ or the return line $L_9$; and further at the terminal C of the incoming line $L_1$ and at the starting point C of the outgoing line $L_2$ is mounted, as shown in FIG. 12, a record erasing device 306 for resetting the information on steaming entered in the information recording medium.

At the branching part A is further mounted a lever 307, which is operated by a rotary solenoid to turn to control the course of trays; and on the opposite side of the reading unit 305 across the transfer line is mounted a stopper 308 for halting the trays for the purpose of reading the information. The lever 307 turns to a dotted-line position when the reading unit 305 has read the information on steaming from the information recording medium of a tray passing therethrough. When no steaming information has been read, the lever 307 rotates to a full-line position to move the tray to the charge line $L_3$. $S_1$ and $S_2$ refer to proximity sensors for ascertaining the passage of the trays.

At the confluence B of the supply line $L_4$ and the introducing line $L_5$ is a stopper 309 for halting a tray for purpose of writing further provided on the opposite side of the writing unit 304,located across the supply line $L_4$. Furthermore, beside the introducing line $L_5$ at the upstream side of the confluence B is provided a photo sensor $S_3$ which responds to the movement of the tray T; and beside the supply line $L_4$ is provided a lever 310 which is turned by a rotary solenoid to close the supply line $L_4$ upon the detection of a tray by the photo sensor $S_3$. Thus the tray on the introducing line $L_5$ side precedes the tray on the supply line $L_4$ when the trays on both the supply line $L_4$ and the introducing line $L_5$ are moving toward the confluence B, thereby preventing the occurrence of bridging of trays.

In the steam setting apparatus thus constituted, the full trays are brought by the incoming line $L_1$ into the yarn end finding device 302, where the yarn end of each spinning bobbin is led out, and it is judged by the reading unit 305 that no information on steaming is present. The full trays are directed by the lever 307 to the charge line $L_3$ side and fed into the steam setter 303 for steam setting. On the full tray coming from the steam setter 303, the information about steaming is written by the writing unit 304. Then the full tray is sent to circulate on the introducing line $L_5$, being fed into a unit demanding the full tray. An empty tray, after unwinding, advances from the discharge line $L_6$ to the outgoing line $L_7$, going into the record erasing unit 306. At this record erasing unit 306 the information on steaming that has been written on the information recording medium is reset by the record erasing unit 306, then being returned to the fine spinning frame S. On the other hand, a full tray that has been fed in the unit but not rewound advances from the outgoing line $L_7$ to the circulation line $L_8$, passes through the yarn end finding device 302 to the reading unit 305, where the presence of steaming is judged, and then further goes into the introducing line $L_5$ through the return line $L_9$.

In the foregoing explanations examples of tray control by the writing unit for writing information on steaming on the information recording medium on the tray and by the reading unit for reading the information from the information recording medium have been described. It is to be noted that a similar result is obtainable by providing, in place of these units for writing and reading the information on steaming, a device for reading and storing a different number or bar code preliminarily attached on every tray which passes, and a device for discriminating the number and bar code stored.

The present invention, being constituted as heretofore explained, has the following advantage.

That is, since spinning bobbins are discharged, without being rewound, from the winder body and not sent into the steam for re-steaming, the automatic winder is advantageous; and moreover there is no deterioration of yarn quality by re-steaming.

What is claimed is:

1. In a system including a spinning frame and an automatic winder, an apparatus comprising:

a bobbin transfer line connecting the spinning frame and the automatic winder, the bobbin transfer line defining a midpoint, a steam setter for steaming bobbins, the steam setter being disposed substantially at the midpoint of the bobbin transfer line, and a preheating apparatus provided substantially between the spinning frame and the steam setter.

2. In a system including a spinning frame and an automatic winder, an apparatus comprising:

a bobbin transfer line connecting the spinning frame and the automatic winder, the bobbin transfer line defining a midpoint, a steam setter for steaming bobbins, the steam setter being disposed substantially at the midpoint of the bobbin transfer line, and a drying line provided substantially between the steam setter and the automatic winder.

3. In a system including a spinning frame and an automatic winder, an apparatus comprising:

a bobbin transfer line connecting the spinning frame and the automatic winder, the bobbin transfer line defining a midpoint, a steam setter for steaming bobbins, the steam setter being disposed substantially at the midpoint of the bobbin transfer line, a preheating apparatus provided substantially between the spinning frame and the steam setter, and a drying line provided substantially between the steam setter and the automatic winder.

4. The apparatus of claim 1, comprising:

an air outlet port opening toward the drying line through which an air stream is directable toward a bobbin on the drying line that has been removed from the steam setter.

5. The apparatus of claim 1, wherein the steam setter defines an outlet and wherein the drying line extends from the outlet of the steam setter in a substantially S-shaped curve along a substantially flat surface.

6. The apparatus of claim 3, comprising:

a housing for enclosing at least a portion of the preheating apparatus and the drying line, a partition plate interposed between at least a portion of the preheating apparatus and the drying line, and a hot-air supply pipe having holes therein provided below the preheating apparatus.

7. The apparatus of claim 2, comprising:

a standby line for holding a plurality of bobbins and for supplying the plurality of bobbins as a group to the steam setter.

8. The apparatus of claim 7, wherein the standby line defines at least one branching portion and comprising:

a tray on which at least one of the bobbins is supported, and tray identification means provides substantially adjacent the branching portion of the standby line for identifying the tray on which at least one of the bobbins is supported.

9. The apparatus of claim 3, comprising:

a standby line for holding a plurality of bobbins and for supplying the plurality of bobbins as a group to the steam setter.

10. The apparatus of claim 9, wherein the standby line defines at least one branching portion and comprising:

a tray on which at least one of the bobbins is supported, and tray identification means provided substantially adjacent the branching portion of the standby line for identifying the tray on which at least one of the bobbins is supported.

* * * * *